United States Patent [19]

Rasinski

[11] 4,041,908

[45] Aug. 16, 1977

[54] SUPER HEATER

[75] Inventor: Edward Rasinski, Hopkins, Minn.

[73] Assignee: Moorhead Machinery & Boiler Co., Minneapolis, Minn.

[21] Appl. No.: 651,603

[22] Filed: Jan. 22, 1976

[51] Int. Cl.[2] ..... F22G 5/00; F22G 7/08

[52] U.S. Cl. ..... 122/479 R; 122/248; 122/485

[58] Field of Search ..... 122/248, 250 R, 479 R, 122/479 S, 481, 485

[56] References Cited

U.S. PATENT DOCUMENTS

| | | | |
|---|---|---|---|
| 1,738,086 | 12/1929 | Wadsworth | 122/250 |
| 3,133,529 | 5/1964 | Wessely | 122/479 |
| 3,269,368 | 8/1966 | McCoy et al. | 122/485 |

*Primary Examiner*—Kenneth W. Sprague
*Attorney, Agent, or Firm*—John W. Adams

[57] ABSTRACT

An auxiliary steam superheater designed to be easily added to an existing steam system to boost the steam temperature to approximately 750° F. This superheater comprising a steam coil system enclosed by an insulated casing which defines a central radiant heating chamber with the coil system spaced inwardly from the inner surface of said casing to provide a convection heat passageway. Hot gases from a heat source are introduced through one end of the casing and into the "interior" of said coil system, thus providing radiant heat directly to the inner surface of said coil system and utilizing the "black body" heat transfer principle. An exhaust flue is provided at the top of said casing in close association to the end of the casing where the hot cases are introduced, the gases flowing through the interior of said coil system and out around the coil along said convection heat path before passing out of said chamber through said flue. Steam temperature and pressure sensing devices are utilized for safe operation of said super heater.

7 Claims, 4 Drawing Figures

FIG. 3
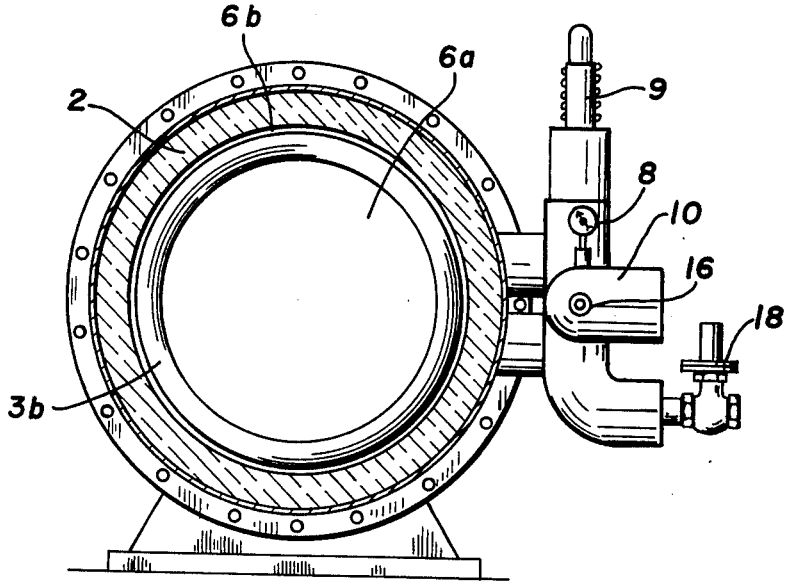
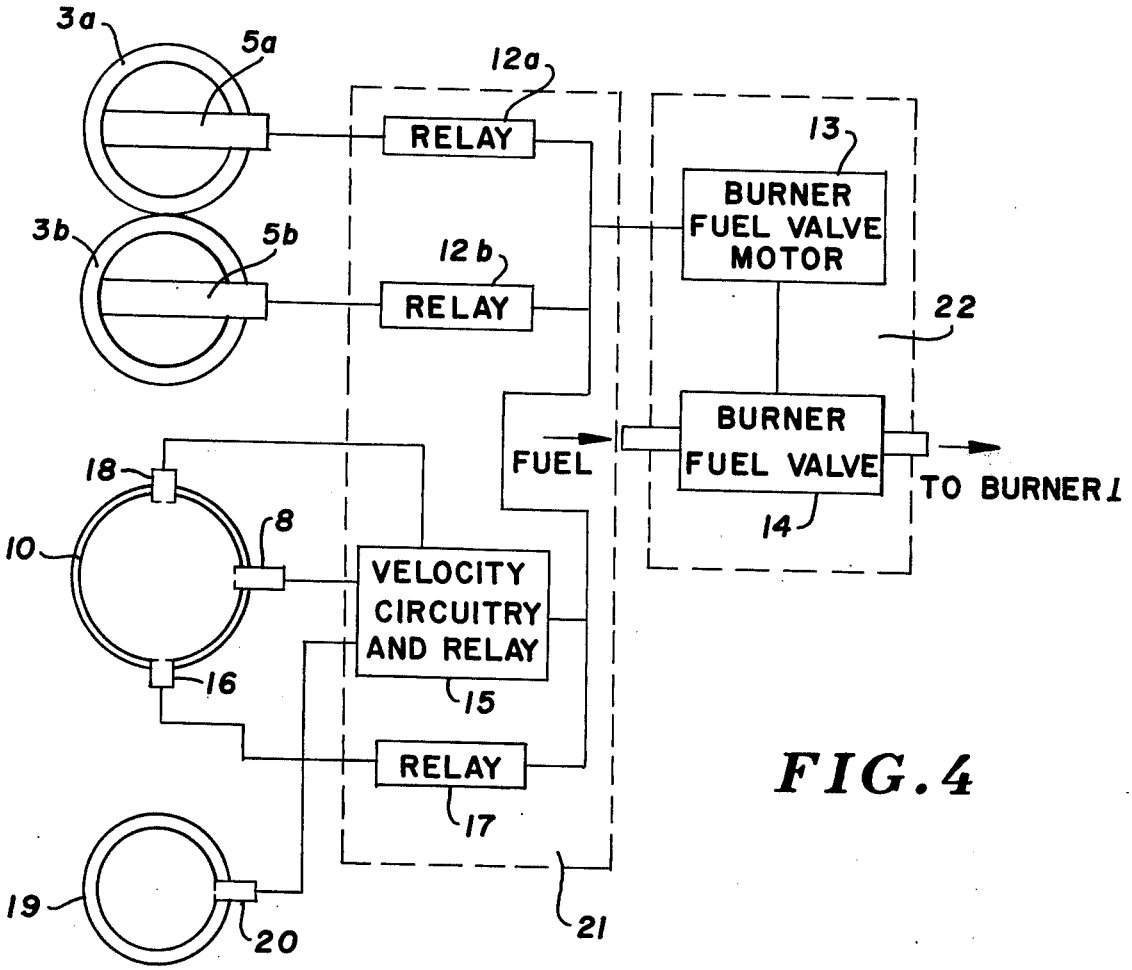
FIG. 4

SUPER HEATER

BACKGROUND OF THE INVENTION

Modern industry has a need for higher steam temperatures than conventional steam heaters can deliver. This need has led to the development of steam superheaters which are adapted for use with conventional steam systems and which are designed to raise the temperature of the steam to approximately 750° F.

Prior art superheaters raise the temperature of the steam by exposing a coil containing the steam to exhaust gases from a furnace, thus heating the steam principally through convection. This method is singularly wasteful as it dissipates the radiant heat produced by said furnace in conventional furnace refactories. A problem is also caused by the great heat buildup along the coil system surfaces, which if not reduced to a tolerable level, results in rapid deterioration and ruputure of said coil system.

This invention utilizes both radiant heat absorption and heat absorption by convection. The radiant heat energy is absorbed by the inner surface of said coil system, and heat remaining in the exhaust gases is further absorbed by convection by the outer surface of said coil system forming the outer exhaust passage. The heat buildup is reduced by using a very high steam velocity, between 5000 and 9000 feet per minute, to conduct the heat very rapidly from the surfaces of said coil system, thus enabling the coil system to be constructed of thinner walled material than prior art superheaters.

It is an object of this invention to provide a superheater for steam which absorbs heat energy both by radiation and convection.

It is a further object of this invention to provide a thin walled highly efficient steam heating coil system in which heat buildup is dissipated by introducing steam into said coil system at very high velocities, thus rapidly scrubbing the buildup heat away from the surfaces of said coil system and providing controls for limiting the temperature within the coil material to permit a relatively inexpensive but safe superheater to be produced.

These and other objects of the invention will more fully appear from the following description made in connection with the accompanying drawings, in which:

FIG. 3 is a transverse vertical section thereof taken substantially along the line 3—3 of FIG. 1; and FIG. 4 is a block diagram showing the control circuitry for limiting pressure and temperature within the coil.

Figure 1:
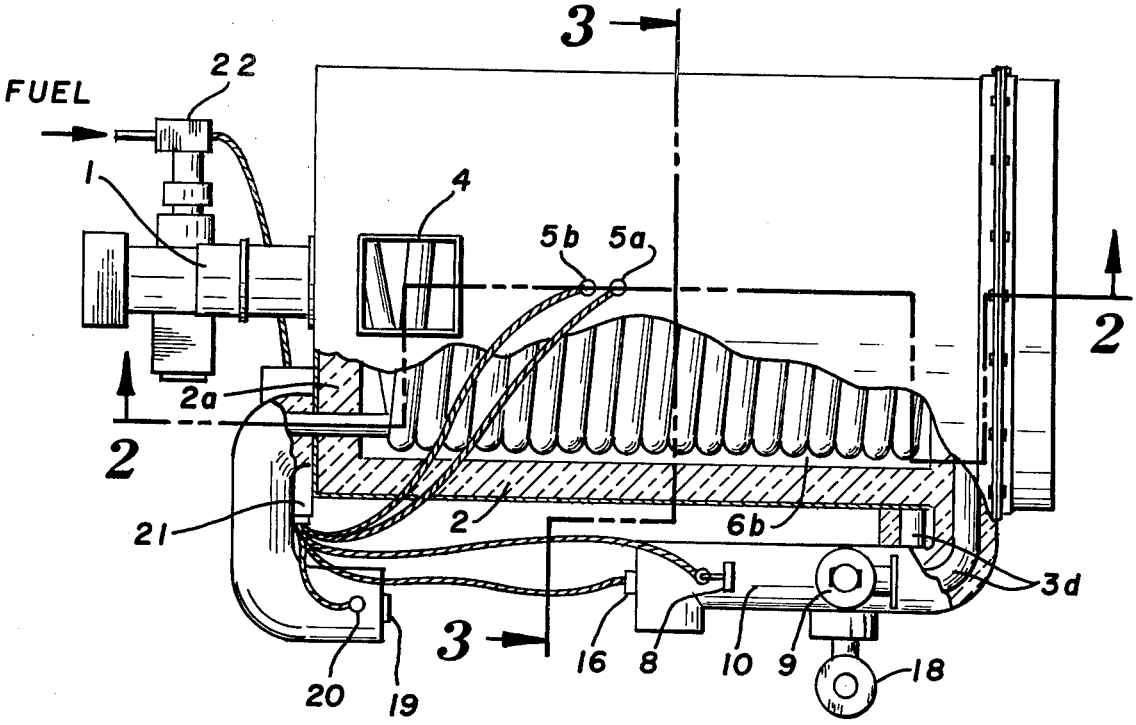
FIG. 1 is a top plan view (partially in section) showing the steam superheat embodying this invention.
Figure 2:
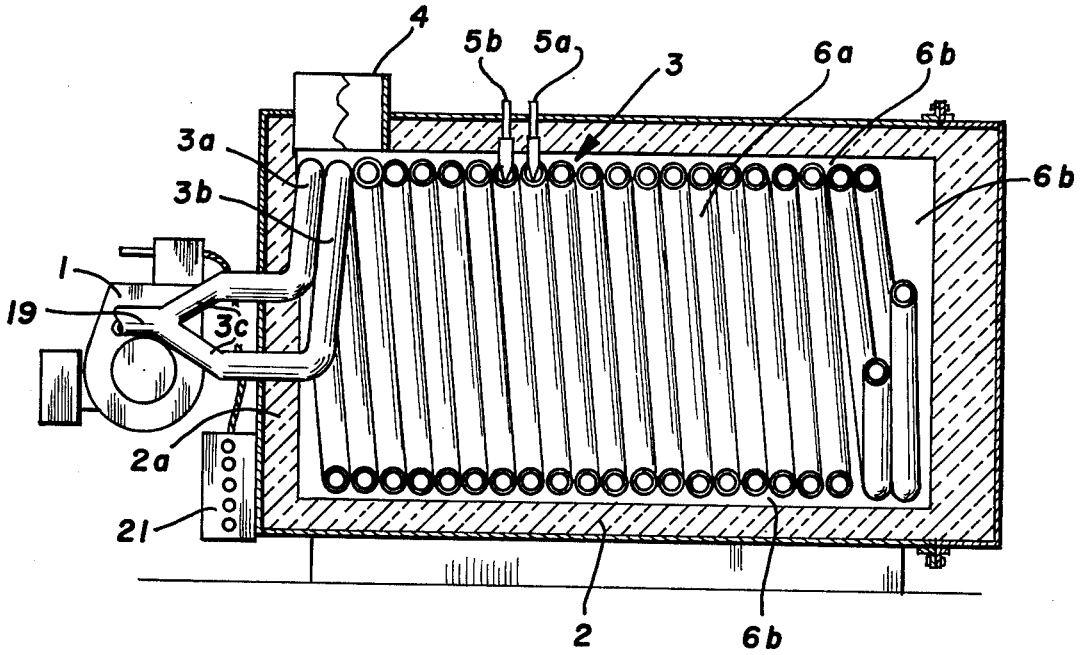
FIG. 2 is a longitudinal vertical sectional view thereof.

Referring to FIG. 1, a heat source is provided in the form of a burner 1, the exhaust outlet of said burner 1 passing through an end wall 2*a* of an insulated casing 2 and into the interior of a hollow helically formed steam heating coil 3 which defines a radiant heat transfer passage 6*a* therewithin. Said coil system 3 comprises two closely spaced parallel pipes 3*a* and 3*b* which are formed into a generally circular coil inside casing 2. The inlets 3*c* for pipes 3*a* and 3*b* pass through end wall 2*a* and are connected to a supply pipe 19, while the outlets 3*d* for pipes 3*a* and 3*b* pass through a wall adjoining wall 2*a* as shown. An exhaust flue 4 is provided in the top of casing 2 and is in closed relation to said end wall 2*a*. A pair of thermocouples 5*a* and 5*b* pass through the top of casing 2 into tubes 3*a* and 3*b* respectively, and are fixed to the inside surfaces thereof.

The inlet end of coil system 3 is joined to wall 2*a* so as to prevent exhaust gases from burner passing between the wall 2*a* and said inlet end. The sides and outlet end of coil system 3 are spaced slightly inwardly from the other walls of casing 2, defining a convection heat passageway 6*b* therebetween.

Said outlets 3*d* join together into one outlet pipe 10. A steam temperature sensor 16 and steam velocity sensor 8 extend into the interior of outlet pipe 10 to monitor steam outlet temperature and velocity, repectively. A steam overload pressure release valve 9 is also fixed to outlet pipe 10 as shown. An inlet steam velocity sensor 20 extends into the interior of said supply pipe 19.

In typical operation, steam is introduced into pipes 3*a* and 3*b* at a very high velocity, which in this embodiment is typically from 5000 to 9000 fpm, and is removed from said coil system 3 through said outlets 3*d* after it is superheated. Exhaust gases from burner 1 are introduced into the interior of said coi system 3, where the radiant heat energy contained in the gases is absorbed by the inner surface of said coil system 3 along said radiant heat passageway 6*a*. Said gases after passing through said radiant heat passageway 6*a* are then forced to flow around the remote end of coil system 3 and through the convection heat passageway 6*b*, where the heat energy contained in said gases is further absorbed by the outer surface of said coil system 3. The gases are then discharged from the casing 2 through the flue 4.

The heat energy transmitted to said inner and outer surfaces of coil system is then absorbed by the steam contained in the pipes 3*a* and 3*b*. To ensure maximum heat energy transfer, said pipes 3*a* and 3*b* are of relatively thin walled construction. To reduce metal deteriorating heat buildup, said steam is passed through said coil system 3 at very high velocities, between 5000 and 9000 feet per minute (fpm), thus quickly absorbing and carrying away said buildup heat before damage is done to said coil system 3.

Referring to FIG. 4, the control circuitry for limiting steam temperature and pressure is shown. Thermocuples 5*a* and 5*b* are fixed to the inner surface of tubes 3*a* and 3*b* respectively. When the temperature of either of said inner surfaces exceeds 750° F, the electrical signals produced by the thermocuples 5*a* and 5*b* will be received by conventional relay circuits 12*a* and 12*b* will then deenergize a burner fuel valve motor 13, which will cause a spring loaded normally closed burner fuel valve 14 to close, shutting off the burner 1. When said temperature falls below 750° F, the relay circuits 12*a* and 12*b* will energize the motor 13 to reopen valve 14 to reestablish normal superheating of the steam.

Said steam velocity sensors 8 and 20 produces electrical signals proportional to the velocity of the steam passing through the coil system 3. When said velocity moves outside a predetermined velocity range, in the present embodiment equall to 5000 to 9000 fpm, the signals produced by said sensors 8 and 20 will cause conventional relay circuitry 15 to deenergize motor 13 to closes valve 14 and open an exhaust valve 18 to exhaust the steam contained in coil system 3.

A temperature sensor 16 is provided at the outlet end of coil system 3 to monitor the temperature of the steam leaving said coil system 3. When the temperature exceeds a predetermined level, in the present embodiment set at 750° F, signals generated by said sensor 16 will cause conventional relay circuitry 17 to deenergize motor 13 and close valve 14, thereby shutting down burner 1 until the steam temperature once again is below 750° F. Said steam overload pressure release valve 9 opens automatically when the pressure of the steam passing through coil system 3 exceeds a predetermined level, thus lowering the pressure of the steam to a safe level. In the present embodiment, this level is set at 154 psi.

It will of course be understood that various changes may be made in the form, details, arrangement and proportion of the parts without departing from the scope of this invention as set forth in the appended claims.

What is claimed is:

1. A steam superheater comprising, a casing including an outside firebox wall construction a hollow steam coil system to define therewithin a central radiant "black body" type heat transfer chamber and mounted within said casing with the outer surfaces of said coil system spaced slightly inwardly from the inside surfaces of the casing wall to provide a convection heat transfer passage around one end and the outside of said coil system, said coil system consisting of a double helical coil unit having the convolutions of the two coils disposed in longitudinally adjacent side by side contact relation to produce coil chamber having the side wall thereof only the thickness of the diameter of a single coil tube to double the steam flow capacity thereof while maintaining the same surface area of contact with the products of combustion from said heat source for both coils.

2. The structure set forth in claim 1 and a rate of flow sensing means mounted in said coil system to denergize said heat source when the rate of flow of steam therethrough falls outside a predetermined range.

3. The structure set forth in claim 2 wherein said rate of flow sensing means is set forth to deenergize said heat source when the velocity of steam is less than 5000 feet per minute at greater than 9000 feet per minute.

4. A steam superheater comprising, a casing including an outside firebox wall construction a hollow steam coil system to define therewithin a central radiant "black body" type heat transfer chamber and mounted within said casing with the outer surfaces of said coil system spaced slightly inwardly from the inside surfaces of the casing wall to provide a convection heat transfer passage around one end and the outside of said coil system, a high output heat source disposed at the other end of said hollow coil system and constructed and arranged to discharge its heat under pressure directly through the interior of said hollow coil system to provide high temperature radiant heat transfer directly to the interior surface of said coil system, an exhaust flue through said outside wall of said casing positioned adjacent the same end thereof as said heat source to cause the products of combustion from said heat source to pass outwardly around the end of said coil system remote from said heat source and return back through said convection passage and out through said exhaust opening, and a safety exhaust valve connected with said rate of flow sensing device to open whenever the rate of flow falls below a predetermined level and exhaust the steam within said coil system to prevent excessive heat and pressure from building up therein immediately after the burner has been shut off.

5. The structure set forth in claim 1 and temperature sensing means mounted in said coil system to monitor the temperature of the coil material and deenergize said heat source when said temperature exceeds a predetermined limit.

6. The structure set forth in claim 5 wherein said temperature sensing means comprise thermocouple means connected to the inner surface of said coil system.

7. The structure set forth in claim 5 wherein said temperature sensing means deenergizes said heat source when the temperature of said coil material exceeds 750° F.

* * * * *